US005870525A

United States Patent [19]

Young

[11] Patent Number: 5,870,525

[45] Date of Patent: Feb. 9, 1999

[54] CAPILLARY FEED BOILER

[75] Inventor: Niels Owen Young, Boise, Id.

[73] Assignee: Allports LLC International, Boise, Id.

[21] Appl. No.: 946,033

[22] Filed: Oct. 7, 1997

Related U.S. Application Data

[63] Continuation of Ser. No. 439,093, May 10, 1995, Pat. No. 5,692,095.

[51] Int. Cl.[6] ..... F24F 6/98; F23D 11/04

[52] U.S. Cl. ..... 392/395; 431/208; 431/241

[58] Field of Search ..... 392/395; 431/206, 431/207, 208, 241, 258, 259, 261, 262; 126/44, 45

[56] References Cited

U.S. PATENT DOCUMENTS

| | | | |
|---|---|---|---|
| 1,944,821 | 1/1934 | Blaise | 392/395 |
| 3,262,290 | 7/1966 | Huber | 67/55 |
| 4,134,718 | 1/1979 | Kayfetz et al. | 431/125 |
| 4,365,952 | 12/1982 | Ohmukai et al. | 431/208 |
| 5,222,186 | 6/1993 | Schimanski et al. | 392/395 |
| 5,405,262 | 4/1995 | Appel | 431/320 |
| 5,692,095 | 11/1997 | Young | 392/395 |

*Primary Examiner*—Teresa Walberg
*Assistant Examiner*—Sam Paik
*Attorney, Agent, or Firm*—Ann W. Speckman; Janet Sleath

[57] ABSTRACT

The invention is an improved boiler for generating vapor at low pressure from liquid in reservoirs that are not pressurized. Liquid from a reservoir is fed through a supply wick by capillary action to a boiler wick in which the liquid is heated and boiled to a vapor. The heat for vaporization is transmitted by a porous hot seat which sits atop and is in contact with the boiler wick. The boiler wick and hot seat are contained within an insulating cylindrical shroud, which forms a tight seal with the edges of the boiler wick. If the liquid to be vaporized is a fuel for a burner, then combustion heat can be used to supply the heat to the boiler. A resistive heat source can also be used to heat the hot seat and boiler wick.

27 Claims, 11 Drawing Sheets

CAPILLARY FEED BOILER

This application is a continuation of application Ser. No. 08/439,093, filed May 10, 1995, U.S. Pat. No. 5,692,095 allowed Mar. 20, 1997.

BACKGROUND OF THE INVENTION

1. Technical Field. This invention relates to boilers for generating vapor from liquid. More particularly, this invention relates to a boiler in which the liquid to be vaporized is fed by capillary action.

2. Background: Boilers are used to convert liquid to vapor in applications in which vapor is necessary, or preferable, to liquid. All boilers serve to add heat to an inflow of liquid in order to vaporize the liquid and create an outflow of vapor. The pressure of vapor generated by a boiler cannot exceed the pressure of the supplied liquid. Therefore, to supply vapor under pressure, an inflow of liquid to the boiler must be supplied under at least as much pressure as is desired for the vapor.

Liquid inflow to large industrial boilers is commonly supplied by a mechanical or jet-ejector feed pump that draws liquid from a reservoir at atmospheric pressure. These feed pumps deliver liquid to the boiler at a pressure at least as great as that desired for the vapor. A throttle valve is typically used to control the flow of vapor from the boiler, and the pressure of the vapor exiting the boiler is a function of the position of the throttle valve. Feed pumps maintain a constant liquid level in a boiler. They do this over a reasonable range of vapor flow and pressure as determined, for example, by a throttle valve position. The liquid flow produced by mechanical or jet ejector feed pumps on boilers is therefore servo controlled to maintain a constant liquid level in the boiler. It is not practical to scale down this kind of system for producing the low vapor flow requirements of devices such as domestic stoves, camp stoves, or mantle lamps.

Camping stoves and other portable burners require the production of gaseous fuel to be mixed with air and combusted. Fuels, such as propane and butane, which are gasses at atmospheric temperature and pressure, are liquids under pressure and occupy smaller volumes for economical storage and transport. This necessitates the use of pressurized containers, with the attendant explosion hazards. Similar hazards exist when the liquid fuel is supplied to a boiler from a reservoir pressurized with gas or air, as in the case of gasoline stoves and mantle lamps.

The boiler of propane and butane stoves is the reservoir or storage tank itself, in which the gasses are liquified under pressure. When vapor is drawn from the reservoir, the reservoir acts as a boiler, and draws the required heat of vaporization from ambient air outside the tank. These types of stoves have many disadvantages. For example, the vapor pressure depends upon ambient temperature, the vapor pressure is generally higher than that needed for satisfactory combustion in a burner and, as previously mentioned, the fuel and vapor are at hazardous pressures. While butane fuel has an advantageous lower vapor pressure than propane, stoves using butane have difficulty producing sufficient vapor pressure at low ambient temperatures. The pressure of propane does not fade at low ambient temperatures. But the vapor pressure of propane nonetheless varies with the tank or ambient temperature and the pressure is inconveniently high. A needle valve can control propane vapor at tank pressure to regulate the heat output of a burner. But burner control by a needle valve tends to be delicate and sensitive to ambient temperature. Alternatively, a pressure regulator can be used to generate a constant and less hazardous pressure of propane that is independent of tank temperature. These are reasons why pressure regulators are commonly used in cookout grilles, recreational vehicles, boats, and domestic propane installations. Unfortunately, regulators are seldom practical for applications at the scale of camp stoves.

It is, therefore, an object of this invention to provide vapor at pressures higher than the pressure of the liquid from which the vapor is created without the use of feed pumps.

It is another object of the present invention to provide vapor at pressures higher than the pressure of the liquid from which the vapor is created without pressurizing the liquid.

It is a further object of the present invention to provide vapor at an approximately constant pressure that is not strongly dependent upon ambient temperature or upon mass flow of the vapor.

Another object of this invention is to provide vapor at a steady flow rate.

Yet another object of the present invention to provide an economical portable stove fueled by unpressurized liquid fuel without the use of feed pumps.

DISCLOSURE OF INVENTION

These and other objects are accomplished by means of a capillary feed boiler in which liquid fuel contained within a fuel reservoir is fed through a supply wick by capillary action to a boiler wick in which the liquid fuel is heated and boiled to a vapor at the point within the boiler wick where it is at the boiling temperature. The heat for vaporization is supplied by a porous hot seat which sits atop and is in contact with the boiler wick. The boiler wick, hot seat, and the upper portion of the supply wick are all contained within an insulating cylindrical shroud, which forms a seal with the edges of the boiler wick, so that the vapor formed in the boiler wick is able to force liquid in a direction away from the hot seat, rather than simply blowing past the boiler wick. Fuel vapor flows upward through the boiler wick, porous hot seat, through a throttle valve, and finally through jet forming orifices into the atmosphere where it mixes with air and burns.

A capillary feed boiler feeds itself with vaporizable liquid under control of a "thermal servo." An example of this thermal servo is the events that follow upon the vapor valve being adjusted to a more closed setting: The vapor pressure rises slightly and momentarily. The increment of vapor pressure forces liquid in a direction away form the hot seat. Heat from the hot seat then arrives at the boiling location within the boiler wick through a greater length of boiler wick. Because the boiler wick is a poor heat conductor less heat is then available to vaporize the liquid. Liquid continues to move in a direction away from the hot seat until its rate of vaporization absorbs a heat flow equal to that heat flow which can be conducted through the increased length boiler wick. Therefore, the location of boiling within the boiler wick adjusts itself automatically in response to the vapor valve setting. Not only the location of boiling, but also the inflow of liquid adjusts itself automatically to the vapor valve setting.

A capillary feed boiler therefore feeds itself liquid by this thermal servo action so that vapor is always available at any flow. Moreover, the vapor pressure is nearly constant, and always very nearly equal to the pressure required to expel liquid from the boiler wick. The lowest pressure which is able to expel liquid from a porous solid is commonly known as the bubble pressure. Bubble pressure is a key parameter used to measure the average pore size in porous solids when the liquid's surface tension is known. The capillary feed therefore has the same result as the much more complicated servo systems used with large boilers that involve mechanical feed pumps or jet ejectors.

The heat source for the hot seat, which provides the heat of vaporization, may be an external resistive electric heat source, or it may be a portion of the heat returned from the combustion of the fuel vapor. Control of the boiling rate of the boiler and hence the heat output of the device, may be either by manual control of the electric resistive heat supply to the hot seat at a constant vapor throttle setting, or by means of an empirically-correct return of combustion heat to the hot seat for all possible vapor throttle valve settings.

The stove has a starter wick for burning a small amount of fuel to provide heat to start the boiling process and to provide a flame to ignite the burning of the fuel vapor. The stove has a fuel reservoir vent which opens while the stove is in operation to provide a path for air from atmosphere into the interior of the fuel reservoir to prevent drawing a vacuum as liquid fuel is consumed.

BEST MODE FOR CARRYING OUT INVENTION

While it should be noted that the shrouded capillary feed boiler of the invention will find many applications, among them small scale steam supplies, mantle lamps, etc., for simplicity, and by way of example only, the invention will be described in the context of a portable camp stove.

Figure 1:
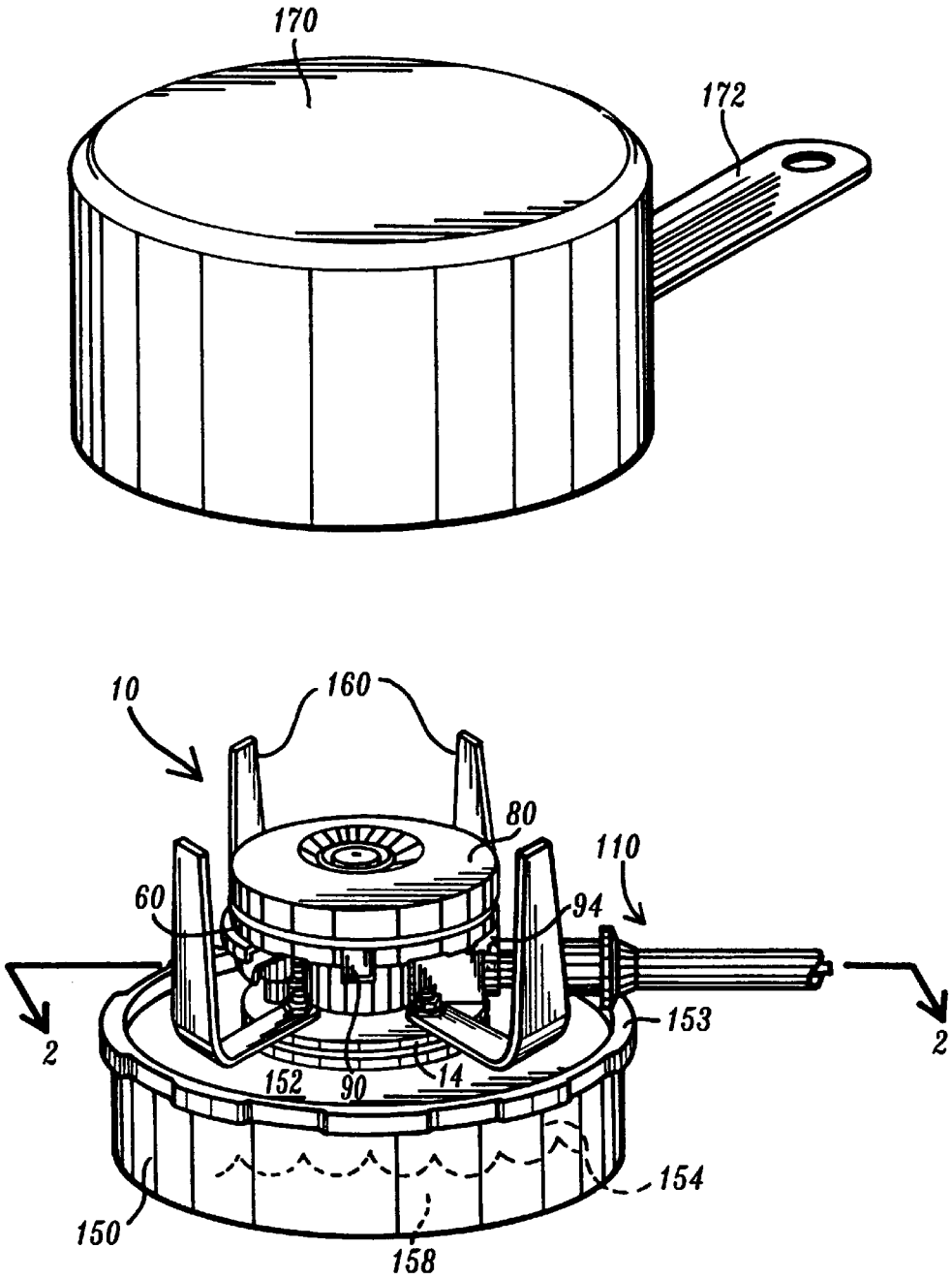
FIG. 1 is a perspective representational view of the camp stove embodiment of the invention.
Figure 2:
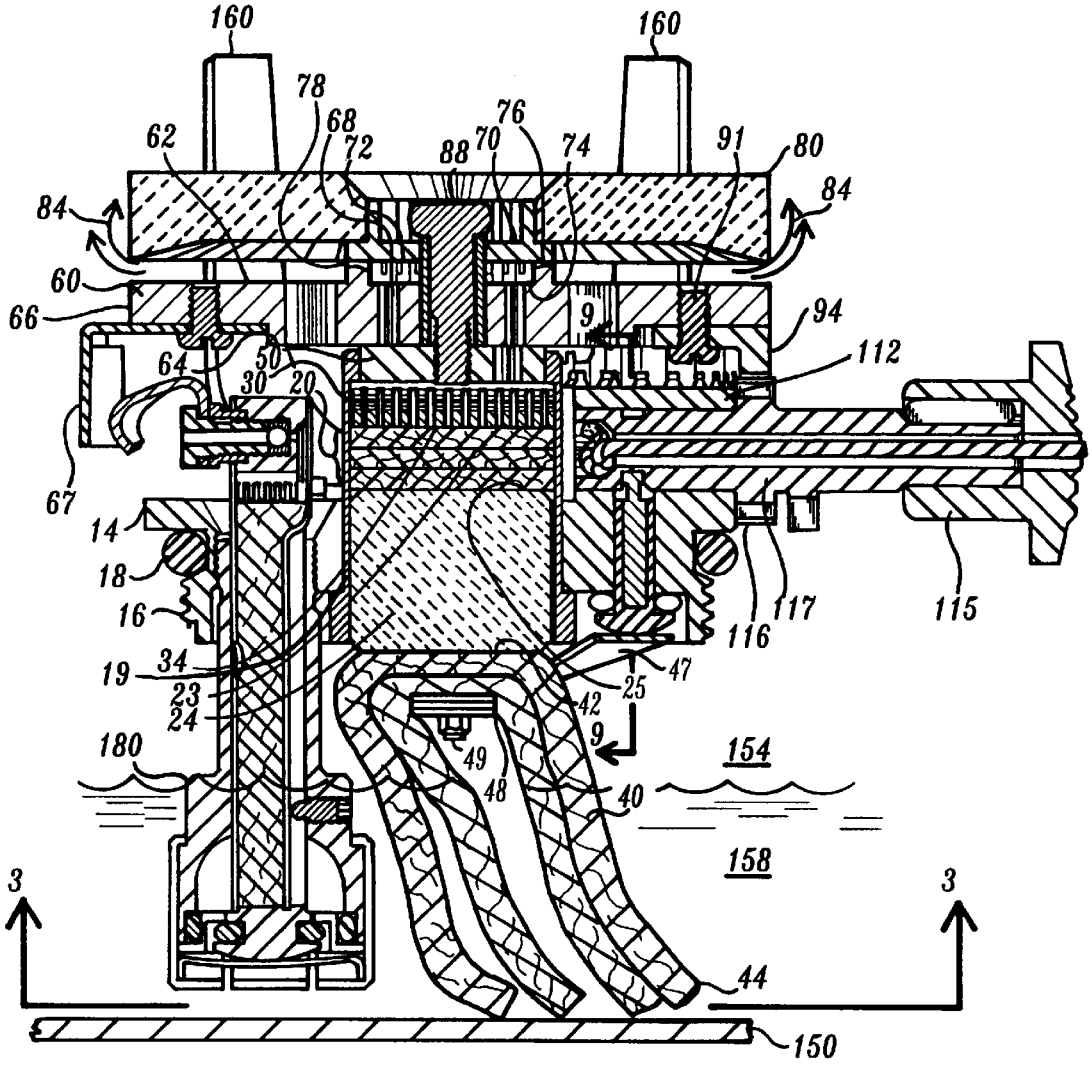
FIG. 2 is a cross sectional view along the line 2—2 of FIG. 1.
Figure 3:
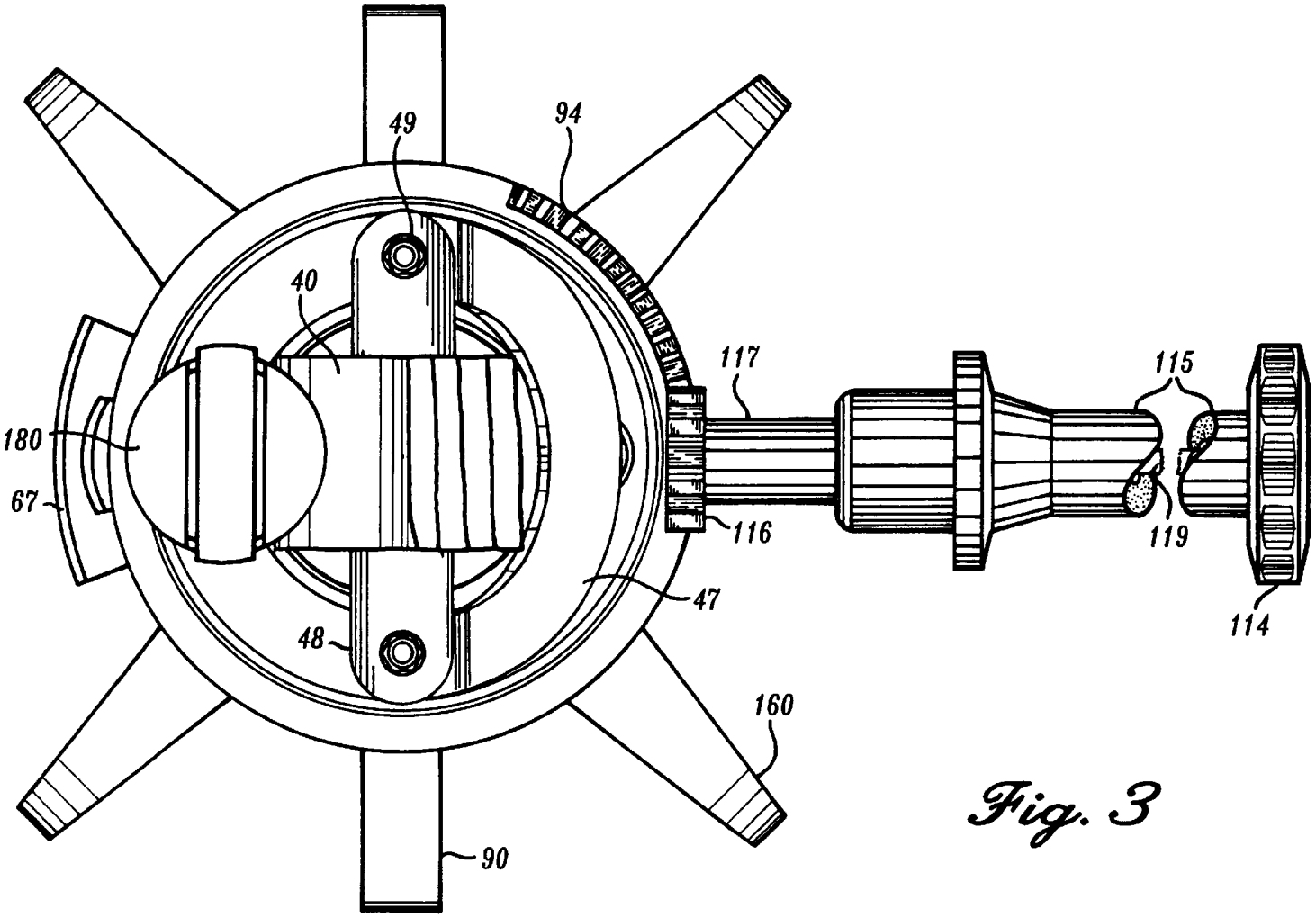
FIG. 3 is a bottom plan view along line 3—3 of FIG. 2.

Referring first to FIGS. 1 and 2, fuel reservoir 150 is a tank for holding liquid fuel 158. Fuel reservoir lid 152, having lip 153 and carrying boiler frame 14 and associated apparatus, provides an air-tight closure to fuel reservoir 150. Boiler frame 14 screws into fuel reservoir lid 152 by means of threads 16, with resilient O-ring 18 providing a fluid tight seal between boiler frame 14 and fuel reservoir lid 152. In the preferred embodiment, fuel reservoir 150, fuel reservoir lid 152, and boiler plate 14 are made of aluminum, which provides a light, sturdy structure. However, in other embodiments these parts could be formed of other materials.

Shroud 19 is an elemental cylindrical member which passes vertically through, and is supported by, boiler frame 14. Shroud 19 is made of a thin wall of solid material which is a poor conductor of heat. Shroud 19 houses transfer wick 24, boiler wick 20, hot seat 30, and aperture plate 50.

Referring now to FIGS. 3 through 7, the top 42 of supply wick 40 is pressed against the lower surface of transfer wick 24 by means of clips 48 and nuts 49. The ends 44 of supply wick 40 dangle freely submerged in liquid fuel 158. Supply wick 40 is made of Kevlar felt in the preferred embodiment, though other porous flexible materials or rigid porous materials, such as glass frit or ceramic may be utilized. Whatever material is used for supply wick 40, the pores should be of appropriate size to wick fuel 158 from fuel reservoir 150 from supply wick ends 44 up and out the top 42 through transfer wick 24 under capillary action and provide liquid fuel 158 to boiler wick 20 at the appropriate boiling pressures. It should be noted that in alternative embodiments, a portion of transfer wick 24 could be directly submerged in liquid fuel 158, obviating the need for supply wick 40.

Boiler wick 20 is a disk shaped member compressed between the upper surface 25 of transfer wick 24 and the lower surface 34 of hot seat 30. In the preferred embodiment, boiler wick 20 is made of three discs of Kevlar felt. However, in other embodiments, boiler wick 20 may be made of other porous materials, such as ceramic, of appropriate pore size. Also, in other embodiments, boiler wick 20 may be of unitary, versus laminar, construction. Boiler wick 20 is designed to fit snugly within shroud 19 so that a seal is formed between circular edge 23 of boiler wick 20 and the inner surface of shroud 19, so that fluid flow will be through the pores through wicking and not through any edge gaps exceeding the average pore size of the boiler wick. Boiler wick 20 must be of appropriate pore size and material so that capillary action provides a supply of liquid fuel and so that heat transferred from hot seat 30 to the boiler wick provides for a boiling transition from liquid to fuel vapor over an appropriate range of temperatures and pressures. If the boiler wick 20 is made of a rigid, porous material, such as a ceramic or metal, a vapor tight seal between edge 23 and shroud 19 may be accomplished by precise manufacture, isometric seals, or by the use of caulking type adhesives. However, it may be more practical to construct boiler wick 20 of a pliable soft material such as plastic foam, conformable bat or felt, as in the preferred embodiment, which can be compressed into the needed sealing contact.

Transfer wick 24 is a generally cylindrical rigid member made of porous material with pore size compatible with that of supply wick 40 and boiler wick 20. In the preferred embodiment, transfer wick 24 is made of ceramic, though it may also be made of metal.

Figure 4:
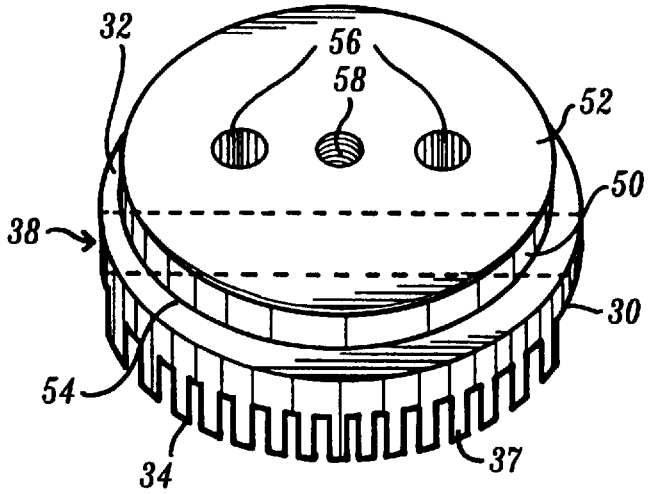
FIG. 4 is an isometric representational view of the aperture plate and hot seat of the invention.

Referring specifically to FIG. 4, hot seat 30 and aperture plate 50 are generally cylindrical members formed or assembled as a unit. In the preferred embodiment, they are unitary in construction. The upper surface 32 of hot seat 30 forms an interface with the lower surface 54 of aperture plate 50. Both are formed of heat conductive materials, such as metals, for conducting heat from heat returns 90 through valve plate 60, and into boiler wick 20 for boiling the liquid fuel. Hot seat 30 and aperture plate 50 may be made of different materials, but in the preferred embodiment both are formed of aluminum.

Figure 5:
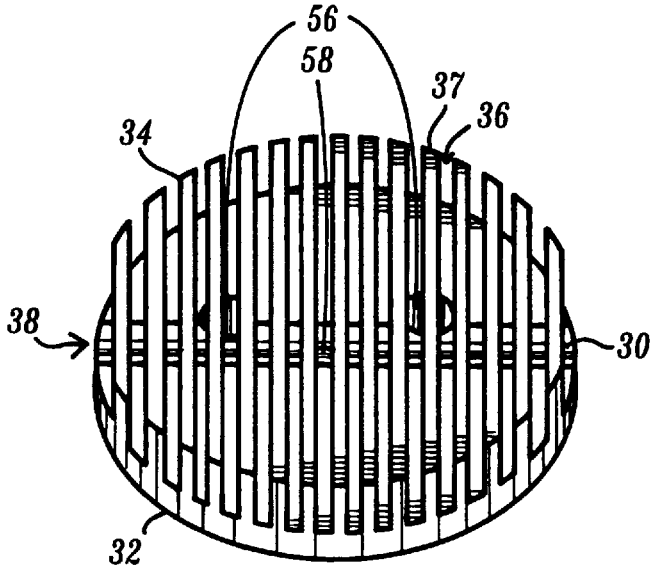
FIG. 5 is an isometric representational view showing the bottom face of the hot seat of the invention.
Figure 6:
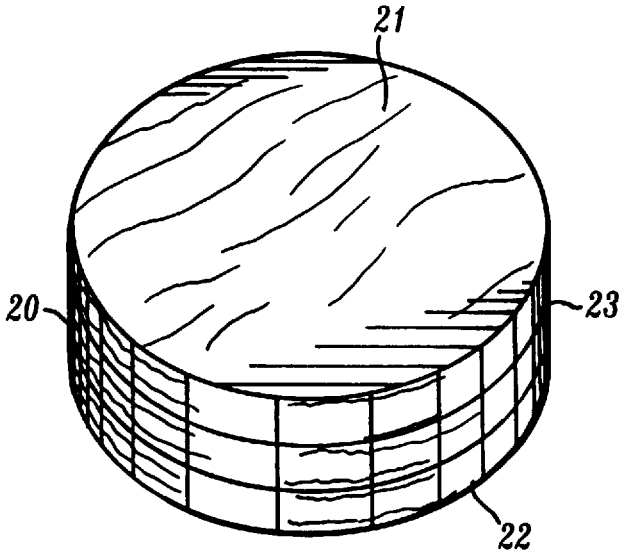
FIG. 6 is an isometric representational view of the boiler wick of the invention.
Figure 7:
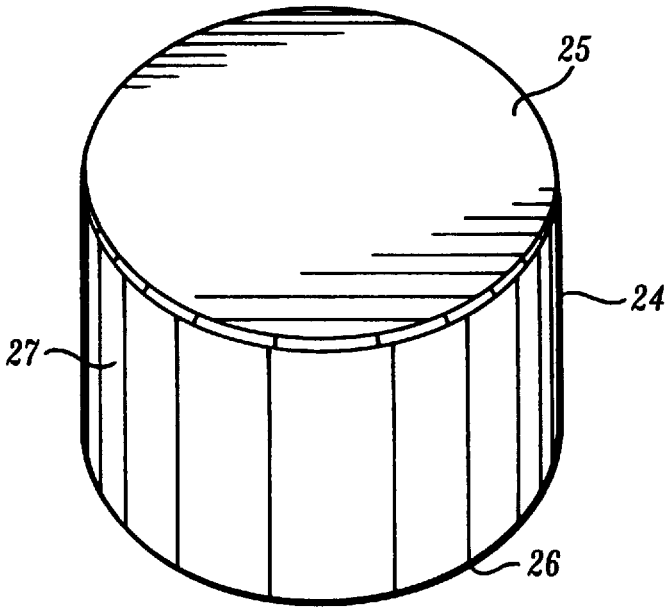
FIG. 7 is an isometric representational view of the transfer wick of the invention.
Figure 8:
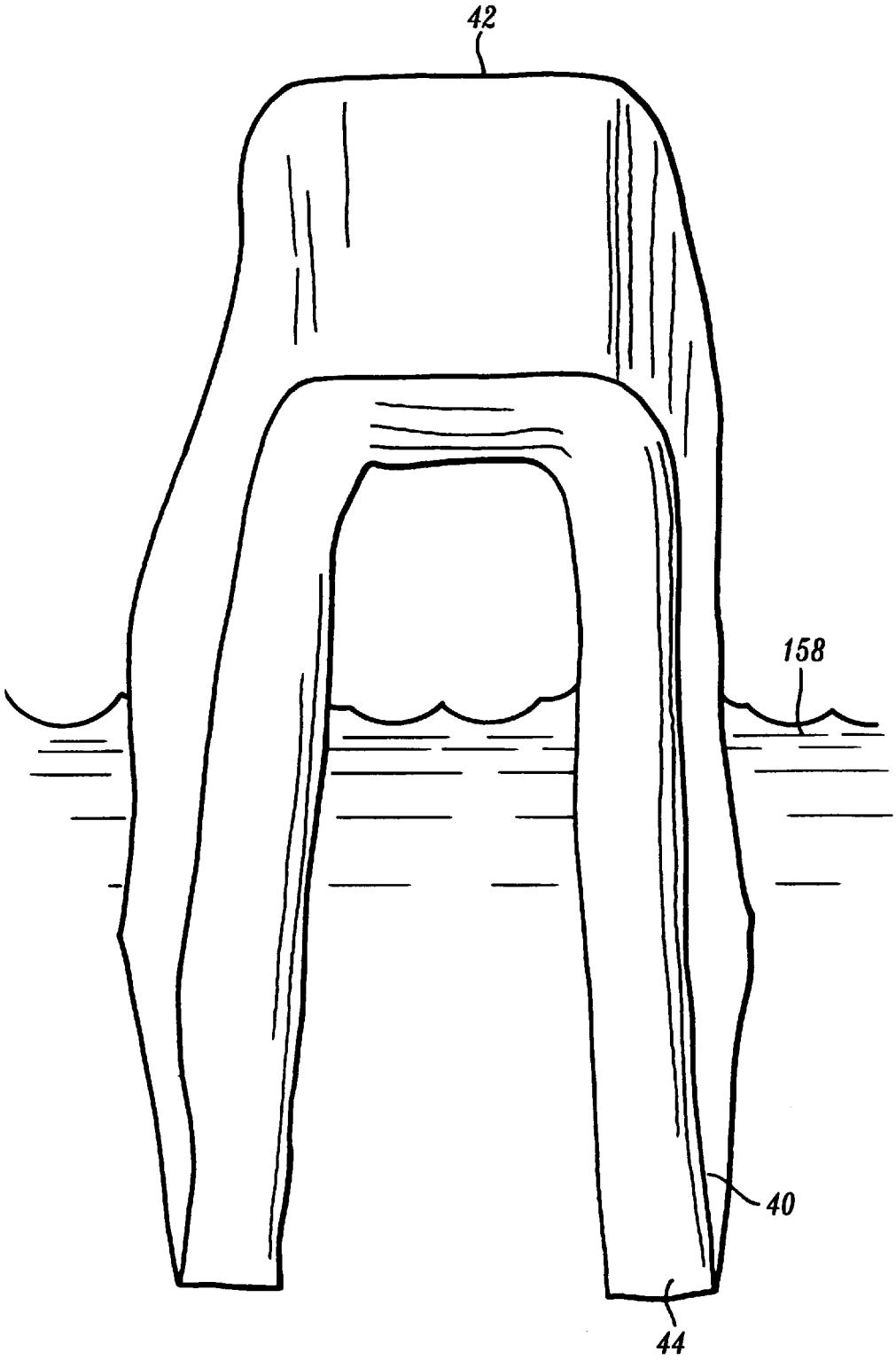
FIG. 8 is a perspective representational view of the supply wick of the invention.

Referring now specifically to FIG. 5, in the preferred embodiment the lower surface 34 of hot seat 30 is provided with a series of narrow slots or grooves cut into the lower surface and extending approximately half of the vertical, or axial, length of hot seat 30. The material between the notches 36 form a series of parallel vanes 37 which contact the upper surface 21 of boiler wick 20. The vanes 37 provide a means of conducting heat from the hot seat to the boiler wick, while the notches 36 between the vanes provide flow passages for the vapor boiling out of boiler wick 20. The upper surface 32 of hot seat 30 is provided with a channel 38 extending sufficiently deep into the vertical length of the hot seat, so that fluid communication is provided from lower surface 34 through notches 36 and through channel 38 for boiling fuel vapors escaping from boiler wick 20 and on to aperture plate 50.

Referring again specifically to FIG. 4, aperture plate 50 is a generally cylindrical disk having upper and lower surfaces 52 and 54, respectively. Lower surface 54 mates with upper surface 32 of hot seat 30, and in the preferred embodiment is formed integrally therewith. Aperture plate 50 is provided with apertures 56 extending through the plate from upper surface 52 to lower surface 54 which provide fluid communication and flow passages for boiled fuel vapor from hot seat 30 to valve plate 60. Screw hole 58 in aperture plate 50 receives screw 88, as shown in FIG. 2, for holding valve plate 60 and additional portions of the apparatus in place.

Referring again to FIGS. 1 and 2, valve plate 60 is a generally cylindrical member having upper and lower surfaces 62 and 64, respectively, and generally circular edge 66. Valve plate 60 provides the dual functions of conducting heat from heat return tabs 90 to aperture plate 50 and thence to hot seat 30, and a means for throttling the flow of fuel vapor out of apertures 56 in aperture plate 50 and on to jet former 70. Heat return tabs 90 extend from edge 66 of valve plate 60, and may be formed integrally therewith. In the preferred embodiment, however, heat return tabs 90 are made of copper and attached to valve plate 60 by means of screws 91.

Starter guard 67, fixedly attached to valve plate 60, prevents operating starter assembly 180 unless valve plate 60 is rotated to align the boiler system for operation, as described below. Ports 68 extend generally vertically through valve plate 60 from lower surface 64 to upper surface 62, and when valve plate 60 is properly aligned, provide fluid communication for fuel vapor between apertures 56 in aperture plate 50 and jet former 70.

Upper surface 62 of valve plate 60 fixedly mates with lower surface 74 of jet former 70. Lower surface 64 of valve plate 60 closely and rotatably contacts upper surface 52 of aperture plate 50. By rotating valve plate 60 about screw 88 through action of control shaft 110, ports 68 in valve plate 60 can be made to come into varying alignment with apertures 56 in aperture plate 50, and thereby adjustably throttling the flow of fuel vapor exiting aperture plate 50 and escaping into jet former 70. In this way, the flame strength, and consequently the heat output, of the stove, may be regulated. In the preferred embodiment, valve plate 60 is made of aluminum, though in other embodiments it may be made of any heat conducting material.

Figure 10:
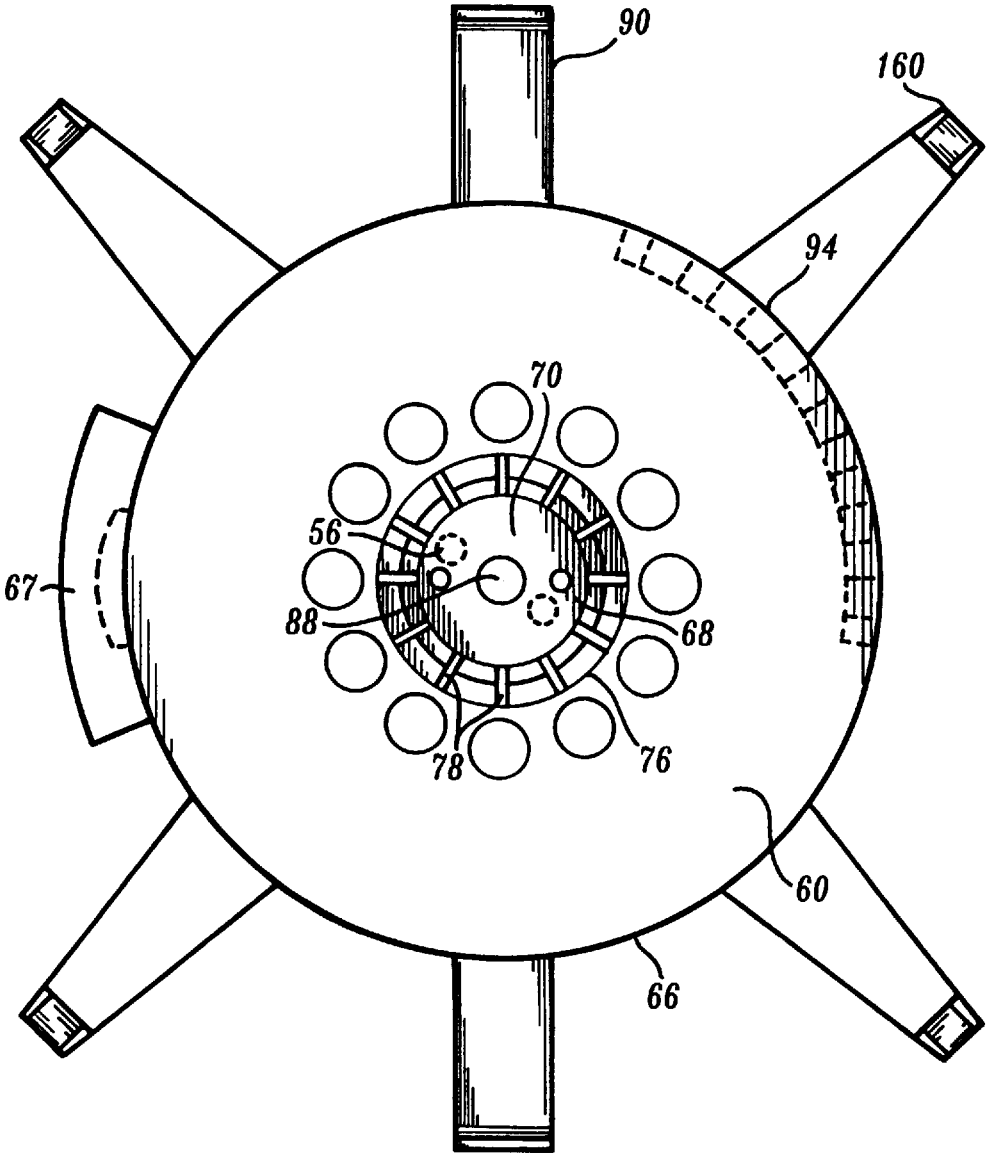
FIG. 10 is a top plan view of the flame plate and aperture and valve plates of the invention.

Referring now to FIGS. 2 and 10, jet former 70 is a generally cylindrical member forming a generally cylindrical hollow chamber, and having upper and lower surfaces 72 and 74, respectively, and an outer edge 76. A series of jet orifices 78 cut through outer edge 76 provide fluid paths for fuel vapor escaping from the central chamber of jet former 70. Jet orifices 78 are sized to form jets of escaping fuel vapor which mix with ambient air, the mixture being then burned to form flames 84. In the preferred embodiment, jet orifices 78 are narrow elemental slots. In the preferred embodiment, jet former 70 is integral with the upper surface 62 of valve plate 60. Jet former 70 rotates about screw 88 along with valve plate 60.

Flame plate 80 is a generally circular disk which sits atop, and is in fixed contact with upper surface 72 of jet former 70. Flame plate 80 rotates about screw 88, along with jet former 70 and valve plate 60. Flame plate 80 is sized in diameter to divert flames 84 horizontally outward from jet orifices 78 and form an essentially circular flame ring, suitable for cooking and heating purposes. In the preferred embodiment, flame plate 80 is made of ceramic, but in other embodiments it could be made of any suitable flame and heat proof material.

Referring specifically to FIG. 10, heat return tabs 90 are fixedly attached to, and extend horizontally outward from, edge 66 of valve plate 60 at equal intervals. The purpose of heat return tabs 90 is to transfer a portion of heat from flames 84 back to hot seat 30. Heat return tabs 90 are empirically sized and shaped to transfer the appropriate amount of heat through valve plate 60 and aperture plate 50 on to hot seat 30. At high vapor flow, a high heat flow is required to vaporize fuel in the boiler; while at low vapor flow, only a little heat is required to vaporize fuel in the boiler. Heat return tabs 90 are shaped and arranged to intercept a portion of flames 84. The size and location of flames 84 depends upon the setting of valve plate 60 relative to aperture plate 50. Therefore, the portion of flames 84 intercepted by heat return tabs 90 varies with the amount of the vapor throttling. This action provides a heat flow into heat return tabs 90 which is appropriate to any setting of the stove. As can be seen in the figures, heat return tabs 90 are angled upward from the horizontal at their ends, such that the larger flames 84 at higher burner settings will impinge upon the upturned ends of the heat return bars. In this way, more of the flames' heat is transferred to heat return tabs 90 and on to hot seat 30 for increased boiling rate. In the preferred embodiment, heat return tabs 90 are made integral with the valve plate 60.

Figure 11:
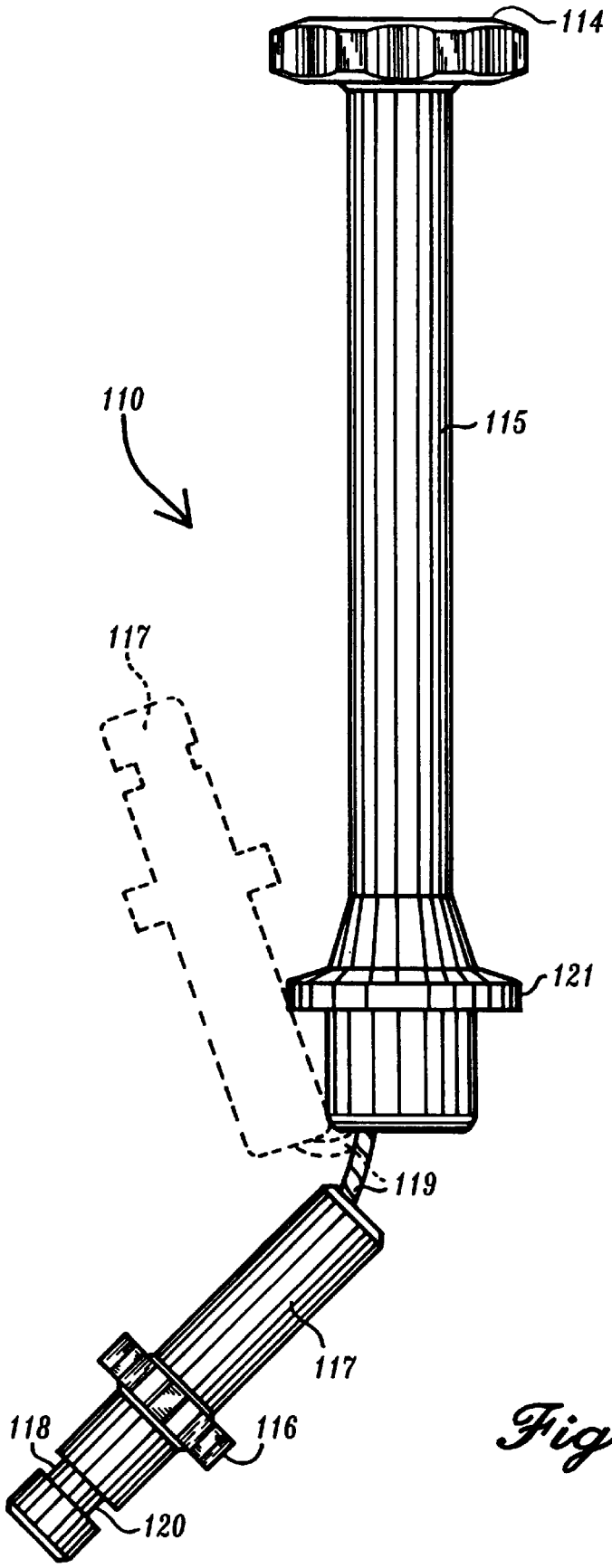
FIG. 11 is a top plan view of the knob and pinion shafts of the invention showing the collapsibility feature.

Referring now to FIGS. 2 and 11, control shaft 110 interfits within, and extends from, shaft housing 112, which itself sits atop boiler frame 14. Control shaft 110 is comprised of two portions, knob shaft 115 and pinion shaft 117, one end of pinion shaft 117 being received within one end of knob shaft 115. Knob shaft 115 and pinion shaft 117 are generally cylindrical, hollow members tied together by internal resilient shock cord 119. This arrangement permits quick reassembly after collapsing the two shafts into a smaller length for ease of portability. Flange 121 of knob shaft 115 is specially shaped to prevent its sliding past fuel reservoir lid lip 153 and detaching from pinion shaft 115 unless control shaft 110 is in a position to shut all valves, thereby providing a stowage interlock.

Figure 9:
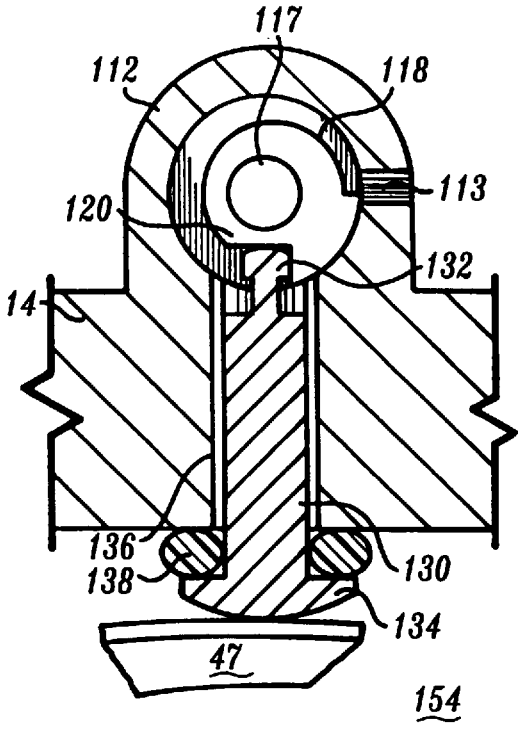
FIG. 9 is a cross sectional view along line 9—9 of FIG. 2.

Control shaft 110 is used to manually control the heat output of the stove by varying the angular position of valve plate 60 relative to aperture plate 50. This is achieved by means of pinion 116 on pinion shaft 117. Pinion 116 interfits with face gear 94, which extends down from valve plate 60. When knob 114 is rotated by hand, causing pinion 116 to rotate and face gear 94 to translate relative to pinion 116, valve plate 60 is caused to rotate about screw 88, thus changing the throttling between aperture plate 50 and valve plate 60, and hence the vapor escaping to jet former 70 and the size of flames 84 exiting jet ports 78. Referring to FIG. 9, pinion shaft 117 is provided with slot 118 and detent 120 within slot 118. Slot 118 is an annular cut extending for 270° rotation of pinion shaft 117. Detent 120 is a flattened, slightly deeper section at one end of slot 118. Slot 118 and detent 120 control the position of vent piston 130 to provide an air path from vent hole 113 into gas space 154 within fuel reservoir 150, as described below.

Referring now to FIGS. 2 and 9, vent piston 130, having tip 132 at its upper end and head 134 at its lower end, is slidably received into vent hole 136 in boiler frame 14. Spring 47 is a resilient, thin metallic semicircular member, the ends of which are fixed by nuts 49. Spring 47 acts on head 134 of vent piston 130, both to hold vent piston 130 in place, and to provide a positive, generally upward force on the piston to force tip 132 into positive engagement with slot 118 of control shaft 110. The diameter of the central portion of vent piston 130 is designed so that there is sufficient clearance between the piston and the inner walls of vent hole 136 to permit the passage of air. Tip 132 of vent piston 130 rides in slot 118 of control shaft 110 as control shaft 110 is rotated to control the heat output of the stove. Slot 118 is designed so that all angular positions of control shaft 110, except when tip 132 is seated in detent 120, vent piston 130 will be in a downward "open" position, permitting the passage of air from atmosphere through vent hole 113 into shaft housing 112, through vent hole 136 along the gap between vent piston 130 and the inner wall of vent hole 136 into gas space 154 of fuel reservoir 150. This air path prevents the drawing of a vacuum in gas space 154 as fuel is consumed and the level of liquid fuel 158 in fuel reservoir 150 decreases.

Slot 118 and detent 120 are placed so that when control shaft 110 has been rotated to close off the fuel vapor escape path through apertures 56 in aperture plate 50, and thus shut down the stove, tip 132 on vent piston 130 will be engaged in detent 120. Detent 120 is cut deeper into pinion shaft 117 than is slot 118, so that when detent 120 engages tip 132 of vent piston 130, vent piston 130 will slide higher into vent shaft 136, seating O-ring 138 at the lower end of vent shaft 136 to seal off the air flow path from atmosphere to gas space 154 and fuel reservoir 150. In this way, when the stove is shut down, fuel reservoir 150 is sealed closed to allow for the stove to be transported in any position relative to horizontal without the danger of leaking or spilling liquid fuel.

Figure 12:
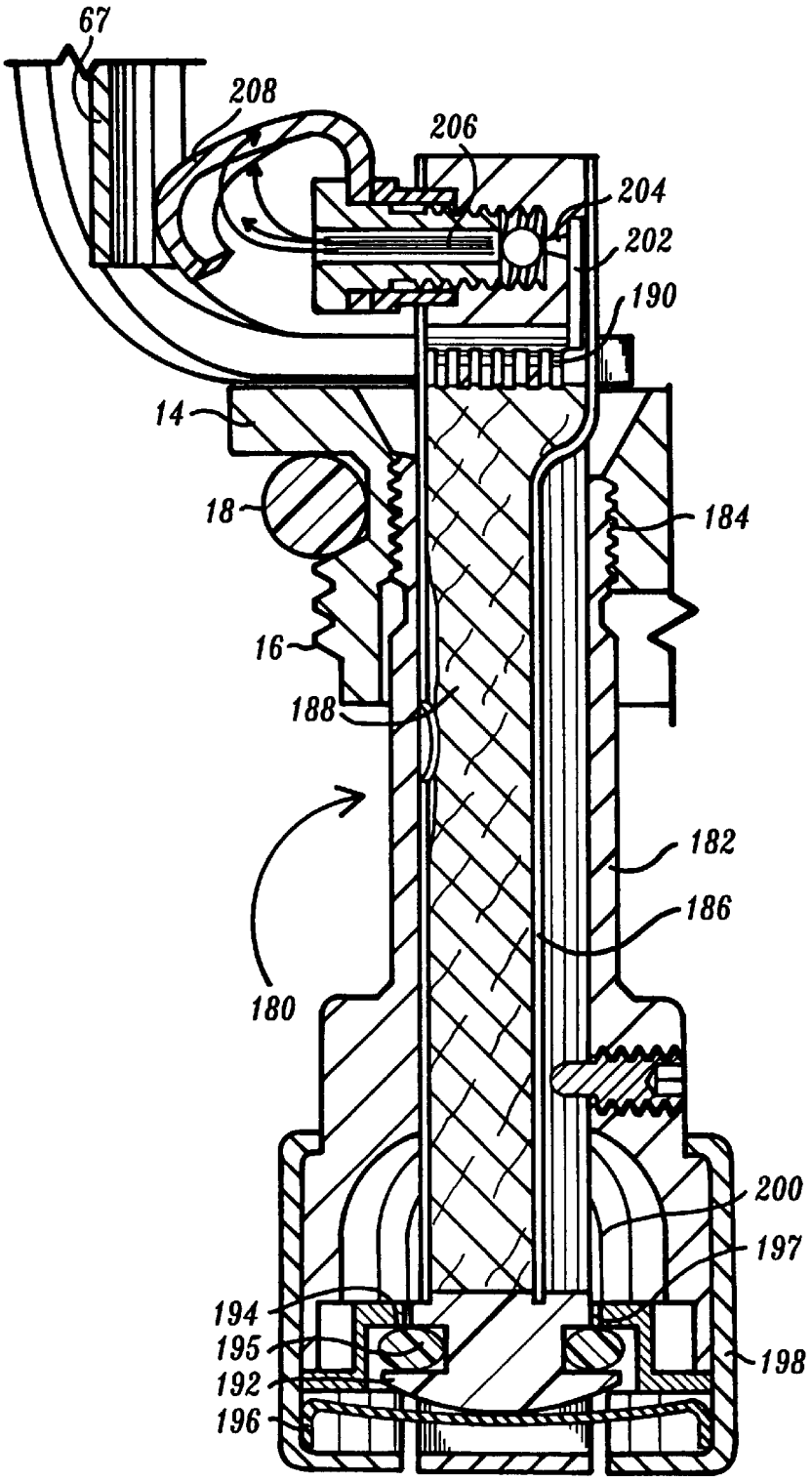
FIG. 12 is a detail view of a portion of FIG. 2 showing the starter assembly of the invention.

Referring now to FIGS. 2 and 12, starter assembly 180 is comprised of a generally cylindrical sheath 182 attached to boiler frame 14 by means of threads 184, and extending down into fuel reservoir 150. Generally cylindrical wick tube 186 is slidably disposed within, and extends a distance above sheath 182. Plunger 192, fixedly attached to the lower end of wick tube 186, moves vertically with wick tube 186. Spring bar 196 applies a generally upward force on plunger 192 and wick tube 186. O-ring 194, disposed within groove 195 in plunger 192, seals shut fuel inlet 197 when plunger 192 is in its uppermost position. Fuel chamber 200 communicates with fuel reservoir 150 when fuel inlet 197 is not blocked by O-ring 194. Starter hot seat 190 is fixedly disposed within wick tube 186 near its upper end. Starter hot seat 190 is a vaned, channeled disc similar to hot seat 30 described above. Starter wick 188 is disposed within sheath 182 and extends from fuel chamber 200 up to the lower surface of starter hot seat 190. Starter wick 188 is made of Kevlar felt in a preferred embodiment, though other porous, flexible materials, or rigid porous materials, such as glass frit or ceramic, may be utilized. Whatever material is used for starter wick 188, the pores should be of appropriate size to wick fuel 158 from fuel chamber 200 up to starter hot seat 190 through capillary action and provide liquid fuel 158 to its upper end at the appropriate boiling pressures. The upper end of starter wick 188 is designed to be at its upper end pressed firmly against the lower surface of starter hot seat 190 and the inner surface of wick tube 186. With wick tube 186 acting as a shroud, starter hot seat 190 and the adjacent portion of starter wick 188 are designed to function as a capillary feed boiler for boiling liquid fuel 158 transferred by the starter wick 188 from fuel chamber 200. Heat transferred from starter hot seat 190 to the upper portion of starter wick 188, provides for a boiling transition from liquid to fuel vapor over the appropriate range of temperatures and pressures.

Boiled fuel vapor from starter hot seat 190 flows upward through passageway 202, through orifice 204, and out through jet tube 206, where the fuel vapor is mixed with air. A combustible mixture of air and fuel vapor exits jet tube 206 while flowing toward the left as shown in FIG. 12 and impinges upon flame shaper 208. Flame shaper 208 divides this gas flow into two equal portions to either side, and generally reverses its direction so that the flow moves toward the right as shown in FIG. 12. After division and redirection, the flow of combustible mixture burns and makes flames which heat the lower surface 64 of valve plate 60. At the same time, flame shaper 208, fixedly connected to the upper end of wick tube 186, captures some of the heat from the combusted starter fuel vapor and returns it back to starter hot seat 190.

Retaining clip 198 holds spring bar 196, plunger 192, and wick tube 186 in place relative to sheath 182.

Operation of starter assembly 180 is as follows: After rotating control shaft 110 to rotate valve plate 60, and with it starter guard 67 away from flame shaper 208, flame shaper 208 is depressed momentarily. Depressing flame shaper 208 will cause wick tube 186, and with it plunger 192, to move downward within sheath 182 against the resistance offered by spring bar 196. When plunger 192 is moved downward, O-ring 194 will no longer block fuel inlet 197, thus allowing fuel 158 from fuel reservoir 150 to flow upward into fuel chamber 200. Once flame shaper 208 is released, wick tube 186 and plunger 192 will return upward, sealing O-ring 194 against fuel inlet 197 and trapping a predetermined amount of fuel into fuel chamber 200. The fuel trapped in fuel chamber 200 will be transported upward under capillary action by starter wick 188, until the liquid fuel reaches the upper end of starter wick 188 in the vicinity of starter hot seat 190.

A flame source is then directly applied to flame shaper 208, which transfers the heat of the flame source to starter hot seat 190. Starter hot seat 190 will transfer the heat to the upper portions of starter wick 188, increasing the temperature of the transported liquid fuel contained within the upper portion of starter wick 188. When the temperature of this liquid fuel reaches the boiling point for the prevailing pressure, the liquid fuel begins to boil. The fuel vapor produced will travel upward through the slots and channel in starter hot seat 190, through passageway 202 and orifice 204, and out through jet tube 206, whereupon it will mix with air and be ignited by the external flame source being applied to flame shaper 208. Once this ignition occurs, the flame source being applied to flame shaper 208 can be removed, since a portion of the heat released by the ignited fuel vapor will be returned through the flame shaper 208 back to starter hot seat 190 to produce a self sustaining capillary feed boiling action.

Flame shaper 208 is designed to direct the flame produced by the combusted starter fuel vapor upward on to valve plate 60, which will transfer the heat through aperture plate 50 to hot seat 30 to begin the main capillary feed boiling action in boiler wick 20. Once the fuel vapor produced by boiler wick 20 exits jet orifices 78, that fuel vapor will mix with air and be ignited by the flame from starter assembly 180 being directed upward by flame shaper 208. Heat return tabs 90 will return sufficient heat from the flames produced at jet orifices 78 to sustain the capillary feed boiling action in boiler wick 20. Once the liquid fuel in fuel chamber 200 has been exhausted by the combustion in the starter assembly 180, starter assembly combustion will cease. Fuel chamber 200 is designed to provide sufficient fuel for commencing a self-sustaining capillary feed boiling action in boiler wick 20 before the combustion in starter assembly 180 ceases.

Referring again to FIG. 1, support prongs 160 provide a surface for setting the cooking pan or other item to be heated by the stove. Support prongs 160 are bent metal tabs fixedly attached to boiler frame 14.

Top 170 is also provided and sized to accommodate the outer circumference of fuel reservoir 150 forming an enclosure for easy transportation of the stove. Handle 172 permits top 170 to function as a cooking pot when inverted. The operation of the stove is as follows: First, liquid fuel 158 is added to fuel reservoir 150 by unscrewing boiler frame 14 and associated apparatus from fuel reservoir lid 152 at threads 16 to expose the interior of fuel reservoir 150. Liquid fuel may be added through the void left in lid 152 by the removed boiler frame 14. A sufficient amount of liquid fuel 158 is added so that when boiler frame 14 is reinstalled, ends 44 of supply wick 40 and plunger 144 will be submerged in fuel. Boiler frame 14 is then screwed back into place in lid 152 of fuel reservoir 150 until O-ring 18 is firmly compressed between boiler frame 14 and fuel reservoir lid 152, providing a tight seal between the interior of the fuel reservoir and atmosphere.

Knob 114 is then turned counter clockwise to rotate control shaft 110, and with it pinion gear 116 so that face gear 94, and with it valve plate 60, rotate clockwise as seen from above about screw 88 to open a fluid communication path between boiler wick 20 and jet former 70. As valve plate 60 rotates, starter guard 67 will move with it to expose flame shaper 208 on starter assembly 180. As control shaft 110, and with it pinion shaft 117, rotate, tip 132 of vent piston 130 disengages from detent 120 and moves counter clockwise along concentric cam slot 118 in pinion shaft 117. This movement causes vent piston 130 to move downward against spring clip 47 and open an air path from atmosphere through vent shaft 136 and into gas space 154 of fuel reservoir 150. The fluid communication path thereby created provides a means for air from the atmosphere to move into gas space 154 to fill the void created by the liquid fuel, which is consumed as the boiler operates.

Next, flame shaper 208 of starter assembly 180 is depressed through wick tube 186, plunger 192 and associated components downward against the resistive force of spring bar 196. This action will open fuel inlet 197 and allow liquid fuel 158 in fuel reservoir 150 to flow upward into fuel chamber 200. Flame shaper 208 is held down momentarily to allow fuel chamber 200 to fill. When flame shaper 208 is released, it, along with wick tube 186, plunger 192, and associated apparatus will move upward, sealing off fuel inlet 197 with O-ring 194. A few seconds delay is here necessary to give time for the liquid fuel in fuel chamber 200 to be transported via capillary action by starter wick 188 upward into the vicinity of starter hot seat 190. Then, an external flame source is applied to flame shaper 208 to heat it and concomitantly starter hot seat 190 to begin the boiling of the liquid fuel in starter wick 188. When fuel vapor exits jet tube 206 and mixes with air, it will be ignited by the external flame source to begin self sustaining combustion and capillary feed boiling of the starter assembly 180.

The combustion flame produced by starter assembly 180 is directed upward and inward by flame shaper 208 and impinges against the adjacent portions of valve plate 60, heating it. This heat is transferred through valve plate 60, aperture plate 50, and hot seat 30 into boiler wick 20.

When the liquid fuel within boiler wick 20 is heated to its vaporization temperature for the extant capillary pressure, the fuel boils and the released fuel vapor escapes upward through the remainder of boiler wick 20, through notches 36 and channel 38 in hot seat 30, through apertures 56 and aperture plate 50, through ports 68 and valve plate 60 and into jet former 70, where it finally escapes through jet port 78. Upon exiting jet port 78 and mixing with air, the released fuel vapor is ignited by the flame from starter wick 140, thus starting the stove. Once the stove has been started, some of the heat from flames 84 is transmitted via valve plate 60, aperture plate 50 and hot seat 30 to boiler wick 20 to sustain the boiling process.

At higher stove outputs, determined by the position of valve plate 60 relative to aperture plate 50, flames 84 will extend a sufficient horizontal distance from jet port 78 to impinge upon heat return tabs 90 and thus provide additional heat transfer back to boiler wick 20 to sustain higher boiling rates necessary for higher fuel vapor production rates. As noted above, heat return tabs 90, as well as the other heat transfer components of the device, are constructed so that an empirically correct amount of heat is transferred to boiler wick 20 to sustain the boiling.

Once the stove is operational, a cooking pan or other item to be heated may be placed atop spider 160. As the cooking or other heating progresses, knob 114 may be used to rotate control shaft 110 as appropriate to throttle the flow of fuel vapor through valve plate 60 and into jet former 70, thus regulating the output of the stove. As different amounts of fuel vapor flow are demanded from the boiler, the heat transfer through hot seat 30 and into boiler wick 20 will automatically adjust to sustain boiling, as described above.

Figure 13:
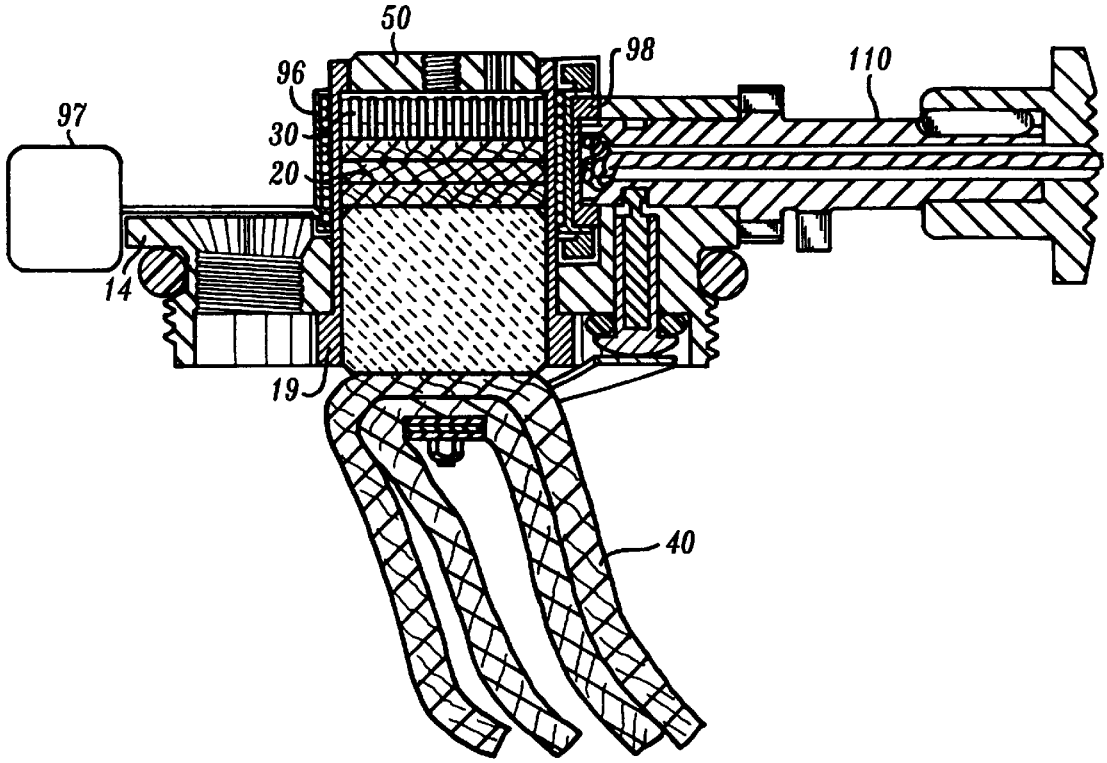
FIG. 13 is a side sectional elevational view of the second embodiment of the invention.

A second embodiment of a liquid fuel stove employing the capillary feed boiler is depicted in FIG. 13. In this embodiment, heat return bars 90 are replaced by resistive heat elements 96 attached to shroud 19, and powered by battery 97. Other embodiments may employ a variety of other electrical power sources. In this embodiment, some heat from combustion inadvertently reaches the boiler by stray conductive, convective, and radiative heat paths. Resistive heat elements 96 add to this stray heat enough to maintain vapor flow. The electrical heat is controlled electronically to maintain the hot seat at a controllable temperature.

The temperature of hot seat 30 is sensed by the resistance of the heat elements 96 using well-known electronic control techniques. With a knob, this temperature is controlled manually.

The second embodiment of the invention does not require a vapor valve. Vapor flows unimpeded from the boiler to the jet forming orifices. The vapor flow depends upon the heat input to the boiler, which in turn depends upon the temperature of the hot seat. Therefore, the output of combustion heat depends upon the manually controlled temperature of the hot seat.

In the first embodiment control of the stove output is achieved by throttling the fuel vapor flow by means of the relative positions of aperture plate 50 and valve plate 60. In this second embodiment, once valve plate 60 is rotated into an open position relative to aperture plate 50, valve plate 60 remains fixed, and stove output is controlled by controlling the heat output of resistive heat elements 96 and hence the boiling rate in boiler wick 20. Rheostat 98, attached to and manually controlled by the rotation of control shaft 110, varies the electrical supply to resistive heat elements 96, and hence the heat output of the heat elements. This arrangement provides an exacting method of controlling the output of the stove for applications in which accurate control is desired. Remaining portions of the camp stove of this second embodiment, such as jet former 70, vent piston 130 and starter wick 140, are similar to those of the first embodiment.

Thus the invention provides a safe, portable, leakproof stove without the need for hazardous pressurized fuel.

While there is shown and described the present preferred embodiment of the invention, it is to be distinctly understood that this invention is not limited thereto but may be variously embodied to practice within the scope of the following claims.

I claim:

1. An apparatus for generating vapor from a liquid comprising:

means for supplying liquid to be vaporized to a capillary boiler wick;

the boiler wick being capable of transferring liquid from a first end to a second end by capillary action, the first end being in liquid transfer contact with the means for supplying liquid to the boiler wick, the boiler wick having a continuous peripheral edge, the second end and the continuous peripheral edge of the boiler wick being contained within a boiler wick containment means that is impermeable to liquids and vapors;

a heat source for supplying heat of vaporization to liquid in the boiler wick; and at least one aperture in the boiler wick containment means in proximity to the second end of the boiler wick for releasing vapor at a pressure higher than the pressure of the liquid entering the first end of the boiler wick from which the vapor is created.

2. The apparatus of claim 1 wherein the means for supplying liquid to the boiler wick comprises a porous, capillary action supply wick.

3. The apparatus of claim 1 wherein the liquid is a liquid fuel and the vapor is vaporized fuel.

4. The apparatus of claim 3 additionally comprising means for combusting the vaporized fuel.

5. The apparatus of claim 4, additionally comprising a jet former having a series of jet orifices providing fluid paths for vaporized fuel.

6. The apparatus of claim 5, additionally comprising a flame plate mounted in proximity to the jet former and sized to divert flames horizontally outward from the jet orifices.

7. The apparatus of claim 4, additionally comprising a manual control for varying the heat output of the stove.

8. The apparatus of claim 4, additionally comprising a starter assembly for initiating vaporization and combustion of liquid fuel.

9. The apparatus of claim 4 wherein the heat source derives heat from combustion of vaporized fuel.

10. The apparatus of claim 1 wherein the heat source is electrical.

11. The apparatus of claim 1 wherein the heat source is capable of providing a variable amount of heat to the boiler wick.

12. The apparatus of claim 1 additionally comprising a liquid reservoir.

13. The apparatus of claim 1 wherein the means for releasing vapor is an adjustable vapor valve.

14. The apparatus of claim 1 wherein the boiler wick containment means comprises a shroud in proximity to the continuous peripheral edge of the boiler wick and an aperture plate in proximity to the second end of the boiler wick.

15. The apparatus of claim 1 wherein the boiler wick containment means comprises a first member constructed from a material which is a poor conductor of heat and a second member constructed from a heat conductive material.

16. The apparatus of claim 14, additionally comprising a hot seat having an upper surface in proximity to a lower surface of the aperture plate, the hot seat deriving heat from combustion of vaporized fuel.

17. A stove capable of generating heat by combustion of a vaporized liquid fuel comprising:

a capillary boiler wick having a first end in liquid transfer contact with a means for supplying liquid fuel to the boiler wick, a second end from which vaporized fuel exits, and one or more peripheral edges;

a boiler wick containment means in proximity to the second end and one or more peripheral edges at the capillary boiler wick;

a heat source for supplying heat of vaporization to liquid fuel in the boiler wick; and at least one aperture in the boiler wick containment means in proximity to the second end of the boiler wick for releasing fuel vapor from the boiler wick containment means at a pressure higher than the pressure of liquid fuel supplied to the first end of the boiler wick, whereby upon release from the boiler wick containment means, fuel vapor is mixed with oxygen to form a combustible mixture.

18. A lamp capable of generating light by combustion of a vaporized fuel comprising:

a capillary boiler wick having a first end in liquid transfer contact with a means for supplying liquid fuel to the boiler wick, a second end from which vaporized fuel exits, and one or more peripheral edges;

a boiler wick containment means in proximity to the second end and one or more peripheral edges at the capillary boiler wick;

a heat source for supplying heat of vaporization to liquid fuel in the boiler wick; and at least one aperture in the boiler wick containment means in proximity to the second end of the boiler wick for releasing fuel vapor from the boiler wick containment means at a pressure higher than the pressure of liquid fuel supplied to the first end of the boiler wick, whereby upon release from the boiler wick containment means, fuel vapor is mixed with oxygen to form a combustible mixture.

19. An apparatus for generating vapor from a supply liquid and providing the vapor at a pressure higher than the pressure of the supply liquid, the apparatus comprising:

a boiler wick in which the liquid is heated and vaporized;

a heat source in thermal transfer relationship with the boiler wick;

a vapor impermeable shroud in proximity to peripheral edges of the boiler wick; and an aperture plate having at least one aperture in proximity to the boiler wick, the aperture plate and the vapor impermeable shroud forming an enclosed space in which the boiler wick operates, and the aperture plate providing passage for vapor to be released from the enclosed space at a pressure higher than the pressure of the supply liquid.

20. The apparatus of claim 19 wherein the liquid is a liquid fuel and additionally comprising means for combusting the vaporized fuel.

21. The apparatus of claim 20 wherein the heat source derives heat from combustion of vaporized fuel.

22. A method for vaporizing a liquid comprising:

introducing the liquid to a first end of a boiler wick capable of transporting liquid by capillary forces, the boiler wick being contained within a boiler wick containment means;

establishing a thermal gradient within the boiler wick, wherein the temperature at the first end is generally ambient and the temperature at another area of the boiler wick corresponds to the vaporization temperature of the liquid;

vaporizing liquid in proximity to the area of the boiler wick at a temperature corresponding to the vaporization temperature of the liquid to produce vapor; and pressurizing the vapor within the boiler wick containment means prior to releasing it, whereby vapor is released from the boiler wick containment means at a higher pressure than the pressure of the liquid introduced to the first end of the boiler wick.

23. The method of claim 22 wherein the liquid is fuel, additionally comprising releasing vapor from the boiler wick containment means, mixing the vapor to produce a combustible mixture, and igniting and burning the combustible mixture.

24. The method of claim 23, additionally comprising returning a portion of the heat generated during burning of the combustible mixture to a portion of the boiler wick for vaporizing the liquid fuel.

25. The method of claim 22, wherein the introduction of liquid adjusts itself automatically to the release of vapor.

26. The method of claim 22, wherein the location of vaporization within the boiler wick adjusts itself automatically to the release of vapor.

27. The method of claim 22, wherein the boiler wick is under control of a thermal servo.

* * * * *